US012709360B2

(12) United States Patent
Peckham

(10) Patent No.: US 12,709,360 B2
(45) Date of Patent: Aug. 18, 2026

(54) HANDLE ADAPTER FOR TOWED WATER SPORTS

(71) Applicant: SPRAY RESEARCH, LLC, Cato, NY (US)

(72) Inventor: Jason Daniel Peckham, Cato, NY (US)

(73) Assignee: SPRAY RESEARCH, LLC, Cato, NY (US)

( * ) Notice: Subject to any disclaimer, the term of this patent is extended or adjusted under 35 U.S.C. 154(b) by 224 days.

(21) Appl. No.: 18/796,773

(22) Filed: Aug. 7, 2024

(65) Prior Publication Data

US 2025/0050981 A1 Feb. 13, 2025

Related U.S. Application Data

(60) Provisional application No. 63/531,396, filed on Aug. 8, 2023.

(51) Int. Cl.
*B63B 34/63* (2020.01)

(52) U.S. Cl.
CPC ..... *B63B 34/63* (2020.02)

(58) Field of Classification Search
CPC ..... B63B 34/63; B63B 34/60
USPC ..... 441/69
See application file for complete search history.

(56) References Cited

U.S. PATENT DOCUMENTS 2,998,797 A 9/1961 Risney
4,740,181 A 4/1988 Kell
5,453,032 A * 9/1995 Crowe ..... B63B 34/63 441/69
5,503,580 A * 4/1996 McCarthy ..... B63B 34/63 114/253
6,306,000 B1 10/2001 Parten et al.
7,959,481 B1 * 6/2011 Wayne ..... B63B 32/70 441/69
8,376,797 B1 * 2/2013 Murphy ..... B63B 34/60 114/253
8,968,043 B1 3/2015 Murphy

OTHER PUBLICATIONS

Masterline, "EVA Pro Trick Handle," 2023, pp. 1-3 https://www.masterlineusa.com/collections/handles/products/eva-pro-trick-handle.

Masterline, "Rope and Handle Bundles," 2023, pp. 1-2 https://www.masterlineusa.com/collections/rope-and-handle-bundles.

(Continued)

*Primary Examiner* — Tye William Abell
(74) *Attorney, Agent, or Firm* — Kintner IP, LLC; Mary Frances Ludwig

(57) ABSTRACT

A handle adapter for towed water sports enables attachment of two ropes to the handle positioned slightly offset from the center and on opposite sides of the handle adapter. This configuration allows the user to grip the handle with both lengths of handle rope between their hands, which increases comfort when making one-handed maneuvers. The handle adapter includes a central body which is structurally configured to prevent any body parts of the user skier from being caught between the ropes, providing improved safety over existing handles with or without handle guards. The handle adapter further provides an offset length for the pivot point of the handle, providing improved handling especially when making tight turns.

11 Claims, 16 Drawing Sheets

(56) References Cited

OTHER PUBLICATIONS

Masterline, "Handle Guards," 2023, pp. 1-2 https://www.masterlineusa.com/collections/mesh-handle-guards.
IWWF, "International Waterski & Wakeboard Federation Waterski Rules 2024," (Include note: see p. 24-25, section 5.11; pub'd Feb. 2024), 2024, pp. 1-110, https://iwwf.sport/wp-content/uploads/2024/02/IWWF-World-Waterski-Rules-2024_V1.pdf.
Sprayresearch, "Instagram Photo," Jan. 25, 2024, pp. 1-3, https://www.instagram.com/sprayresearch?igsh=eTR6ZzA5eHZ5b3A4&utm_source=qr.

* cited by examiner

HANDLE ADAPTER FOR TOWED WATER SPORTS

CROSS REFERENCE TO RELATED APPLICATION

This application claims the benefit of U.S. Provisional Application No. 63/531,396, filed Aug. 8, 2023, which is hereby incorporated in its entirety.

TECHNICAL FIELD

The present invention pertains generally to arrangements for towing in water sports, and more particularly to a handle adapter for towed water sports, or system including said handle adapter.

BACKGROUND OF THE INVENTION

Handles for towed water sports, such as waterskiing, typically include a handle piece, which may be a straight or bent rod, that may have holes near each end for attaching a rope (which may be referred to herein as a handle rope). The open area in between the two handle ropes may be referred to as the bridle area. The handle rope generally extends several feet away from the handle, and may terminate in a loop for easy attachment to a tow rope connected to a watercraft. A handle and tow rope may be packaged together and sold as a kit.

A user of such a handle typically grasps the handle in the bridle area. This configuration presents a safety hazard. For example, in waterskiing if the skier falls into the water and there is some amount of slack (loose line) in the handle rope, as the towing boat continues to move forward the line will tighten and jerk the handle, along with whatever may be in the bridle area (such as any body part of the skier). To address these safety problems, some skiers use a "handle guard", which may cover the majority of the open bridle area while leaving room for the skier's hands to grasp the handle. Handle guards are quite effective for preventing head and neck injuries, which, although rare, have resulted in fatalities. However, the handle guard may still allow other body parts, such as hands, arms, feet, or legs, into the bridle area, and thus do not prevent injuries to these body parts.

During a turn in waterskiing, the skier may let go of the handle with one hand and move their body away from the handle (e.g., to make it easier to get around a buoy). To make this maneuver, it may be desirable to locate the handle rope in between the skier's hands. However, locating the handle rope in the center of the handle allows the handle to pivot around the rope, and makes the handle unstable.

There is therefore a need in the art for improved safety, comfort, and functionality in handle apparatus for towed water sports.

BRIEF SUMMARY

Examples disclosed herein are directed to handle adapters and handle systems for towed water sports such as waterskiing, wakeboarding, wake surfing, or other wake sports, skurfing, or the like. The handle adapter enables attachment of two ropes to the handle, each rope located slightly offset from the center and on opposite sides of the handle adapter. This configuration allows the user to grip the handle with both lengths of handle rope between their hands, which increases comfort when making one-handed maneuvers. The handle adapter, systems, and methods of use improve both safety and comfort for the user. The handle adapter includes a central body which is structurally configured to prevent any body parts of the user skier from being caught between the ropes, providing improved safety over existing handles with or without handle guards. The handle adapter further provides an offset length for the pivot point of the handle, providing improved handling especially when making tight turns.

According to one or more examples, a handle adapter for towed water sports is configured to cooperate with a rope and a handle having two handle ends. The handle adapter includes: a proximal end, a distal end, and two outer sides; a bore defined by a bore sidewall, the bore located adjacent the proximal end and opening to both of the two outer sides, the bore shaped and dimensioned to receive the handle therethrough; two channels each structurally configured for the rope to pass therethrough, one of the two channels located adjacent each of the two outer sides of the handle adapter, each of the two channels having a channel sidewall, a maximum thickness of the channel sidewall defining a channel thickness; a central body located intermediate the two channels and extending therebetween, the central body having a central body thickness that is less than the channel thickness; wherein each of the two channels has a proximal channel end and a distal channel end, and the proximal channel end opens to one of the two outer sides; and wherein, when the handle is received by the bore, the proximal channel ends are located between the two handle ends.

According to one or more examples, the handle adapter further includes a substantially planar wing extending from each of the two outer sides.

According to one or more examples of the handle adapter, the two channels are angled such that a first distance measured between the proximal channel ends of the two channels is larger than a second distance measured between the distal channel ends of the two channels.

According to one or more examples of the handle adapter, the distal channel ends of the two channels open to a common distal opening.

According to one or more examples of the handle adapter, at least one of the proximal channel end and the distal channel end is tapered.

According to one or more examples of the handle adapter, the handle adapter has a stiffener length measured from the distal end to a distal surface of the bore, the stiffener length being between about 10 cm and about 24 cm.

According to one or more examples of the handle adapter, the central body includes a plurality of apertures.

According to one or more examples of the handle adapter, the handle adapter is unitarily formed.

According to one or more examples, the handle adapter is further configured to cooperate with a fastener, and the bore sidewall includes a fastener hole structurally configured to receive the fastener.

According to one or more examples of a handle system for towed water sports, the handle system is configured to cooperate with a rope. The handle system includes: a handle adapter including: a proximal end, a distal end, and two outer sides; a bore defined by a bore sidewall, the bore located adjacent the proximal end and opening to both of the two outer sides, the bore shaped and dimensioned to receive the handle therethrough; two channels each structurally configured for the rope to pass therethrough, one of the two channels located adjacent each of the two outer sides of the handle adapter, each of the two channels having a channel sidewall, a maximum thickness of the channel sidewall defining a channel thickness; a central body located intermediate the two channels and extending therebetween, the central body having a central body thickness that is less than the channel thickness; wherein each of the two channels has proximal channel end and a distal channel end, and the proximal channel end opens to one of the two outer sides; and a handle inserted through the bore of the handle adapter and structurally configured for a user to grip two handle ends thereof, each of the two handle ends located on opposing sides of the bore.

These and other aspects of the examples will be better appreciated and understood when considered in conjunction with the following description and the accompanying drawings. The following description, while indicating various examples and details thereof, is given by way of illustration and not of limitation. Many substitutions, modifications, additions, or rearrangements may be made within the scope of the examples, and the examples may include all such substitutions, modifications, additions, or rearrangements.

BRIEF DESCRIPTION OF THE DRAWINGS

Non-limiting and non-exhaustive examples of the handle adapter and systems therewith are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various examples. Also, common but well-understood elements that are useful or necessary in a commercially feasible example are often not depicted in order to facilitate a less obstructed view of these various examples.

DETAILED DESCRIPTION OF THE INVENTION

The detailed description describes non-limiting examples. Any individual features may be combined with other features as required by different applications for at least the benefits described herein. As used herein, the term "about" means plus or minus 10% of a given value unless specifically indicated otherwise. As used herein, the terms "substantially" or "substantially the same" mean that two items are at least 90% the same; for example, a feature described as "substantially parallel" may be parallel to within 90%, an element described as "substantially circular" may be circular to within 90%, and so on.

As used herein, the conjunction "or" is to be construed inclusively (e.g., "A or B" would be interpreted as "A, or B, or both A and B"; e.g., "A, B, or C" would be interpreted as "A; or B; or C; or any two of A, B, and C; or all three of A, B, and C").

As used herein, disclosure of a singular element is also a disclosure of a plural element and vice versa unless otherwise noted.

As used herein "proximal" generally refers to a location near the handle or user thereof, while "distal" generally refers to a location away from the handle or user (e.g., in the direction of a watercraft).

Figure 1:
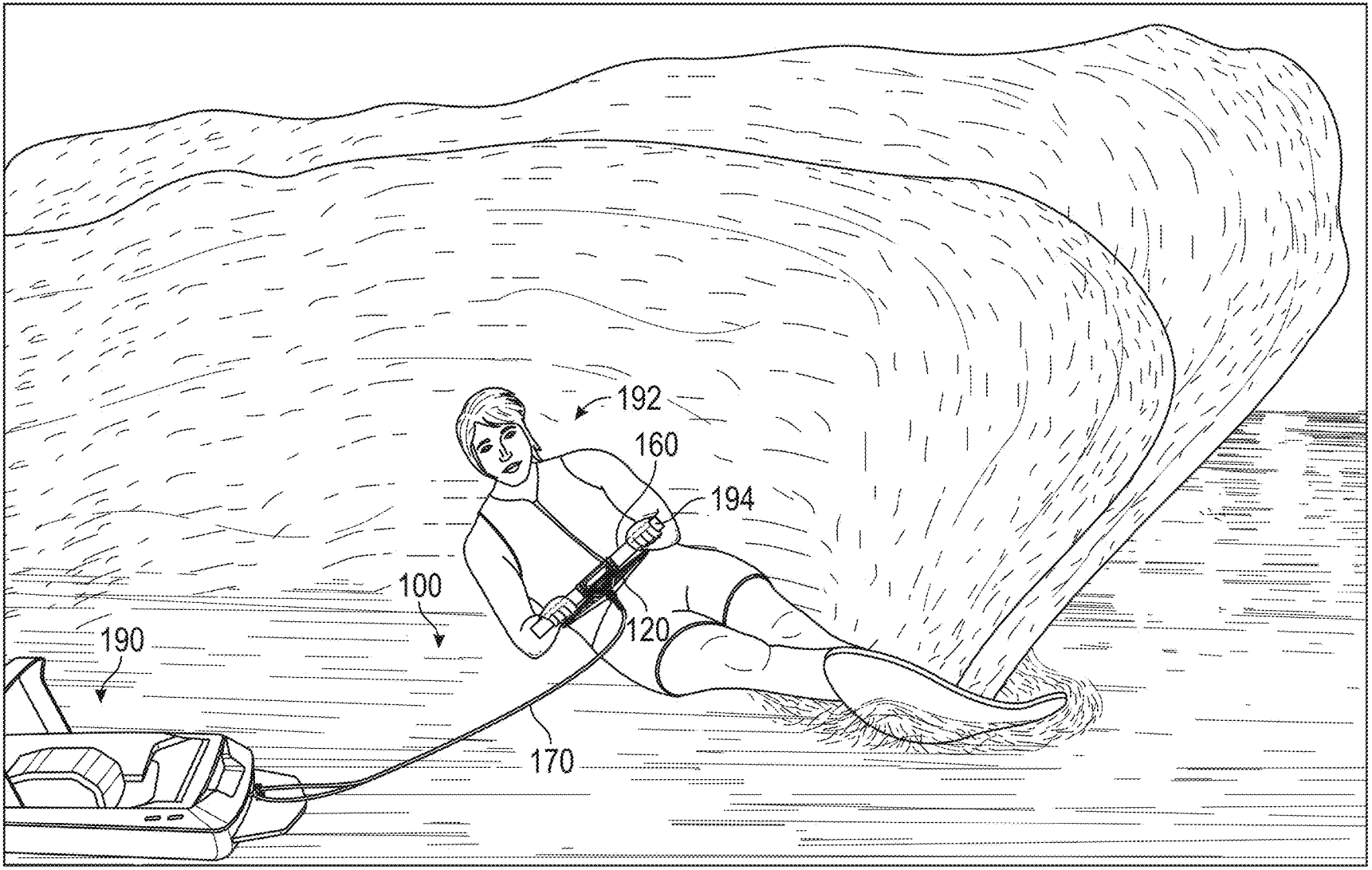
FIG. 1 is an example illustration of a handle for towed water sports, shown in use.

FIG. 1 is an example illustration of a handle system 100 for towed water sports, shown in an example use scenario. In general, the handle system 100 may include a handle adapter 120, a handle 160, and one or more ropes 170. The handle adapter 120 may be similar to any of the exemplary handle adapters described herein, and may, in general, enable attachment of one or more ropes (e.g., two ropes) to the handle 160, with the rope 170 located slightly offset from the center of the handle 160 and on opposite sides of the handle adapter 120. This arrangement allows a user 192 to grip the handle with the rope located between their hands 194, which improves safety and increases comfort, especially when making one-handed maneuvers. The rope 170 may be structurally configured for connection to a cooperating watercraft 190, such as by tying the rope 170 to a tow rope (not shown) that may be connected to the watercraft 190, or by directly tying the rope 170 to a tow ring or similar connection point located, for example, at the stern of the watercraft 190.

Figure 2:
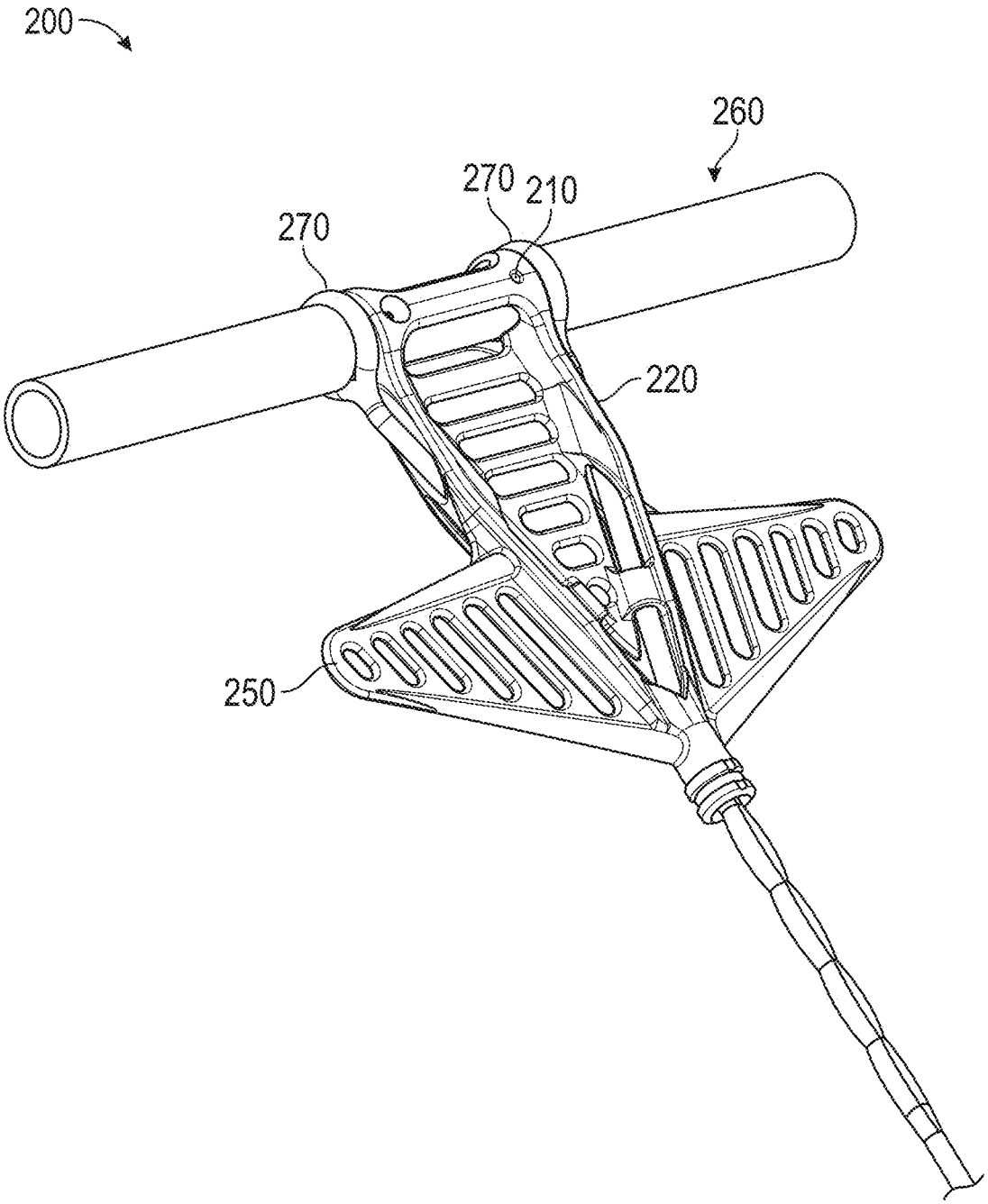
FIG. 2 is an example illustration of a perspective view of the handle.
Figure 3:
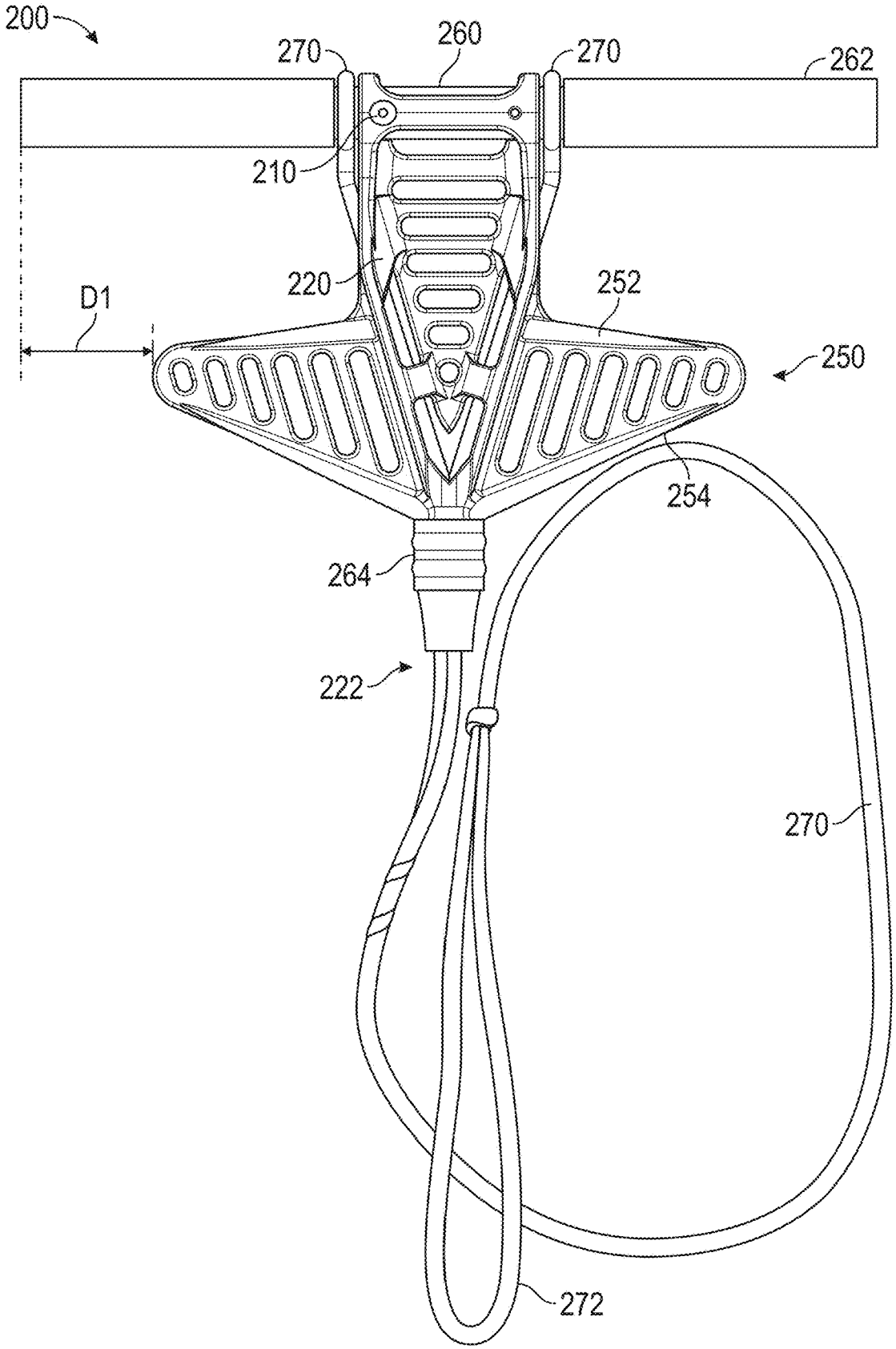
FIG. 3 is an example illustration of a front view of the handle.
Figure 5:
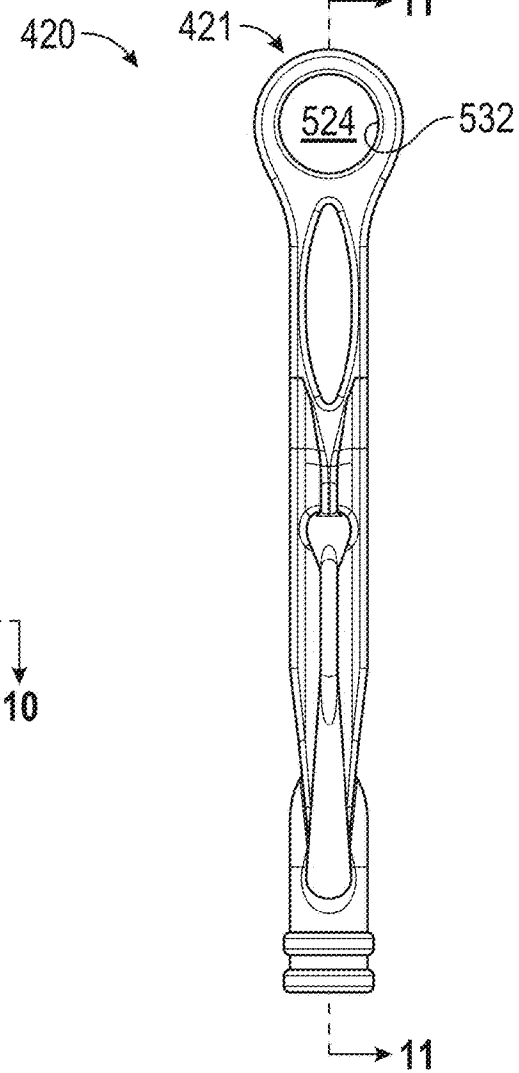
FIG. 5 is an example illustration of a first side view of the handle adapter, the opposing second side view being, or substantially being, a mirror image.
Figure 4:
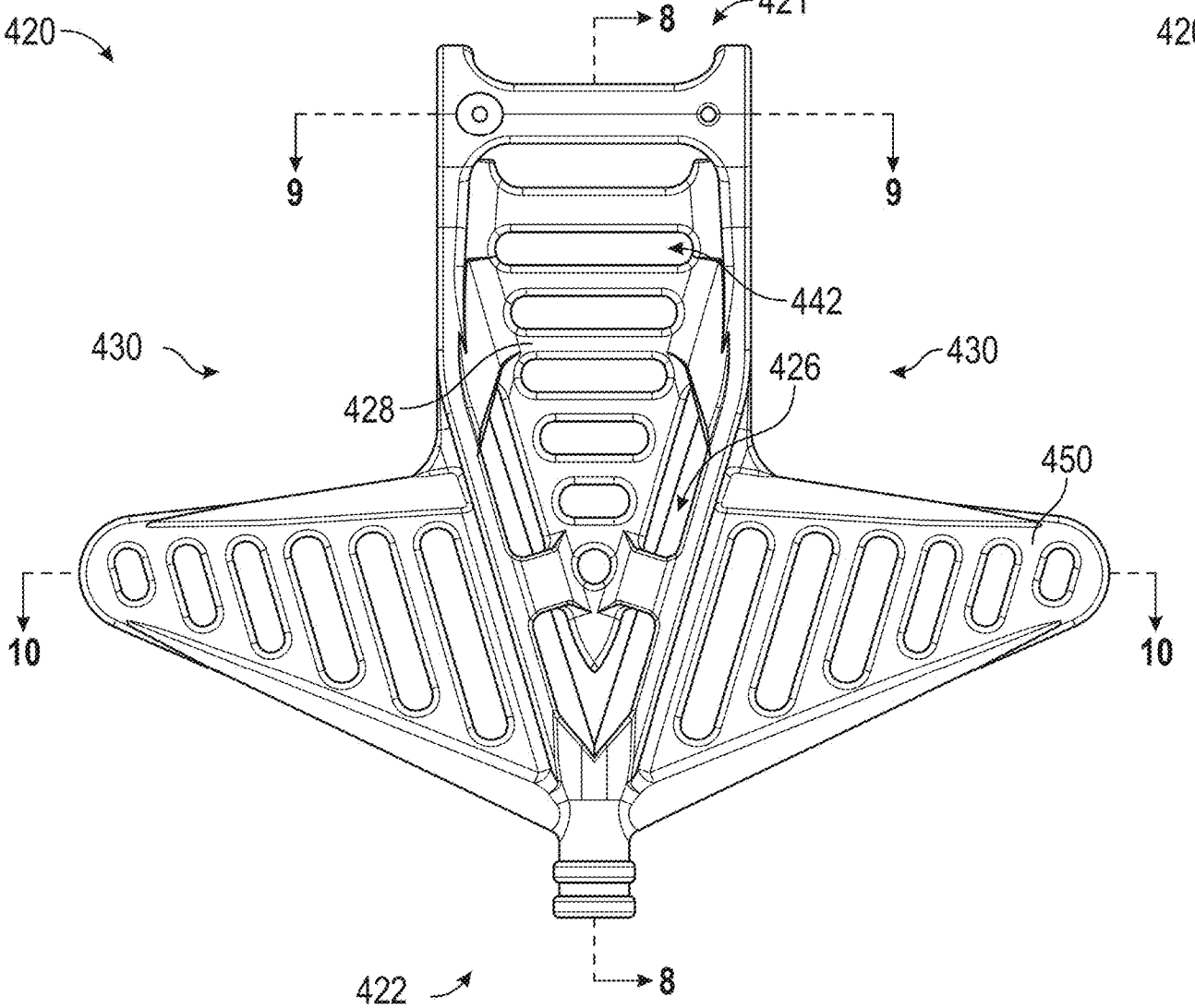
FIG. 4 is an example illustration of a front view of the handle adapter, the rear view being identical, or substantially identical.
Figure 6:
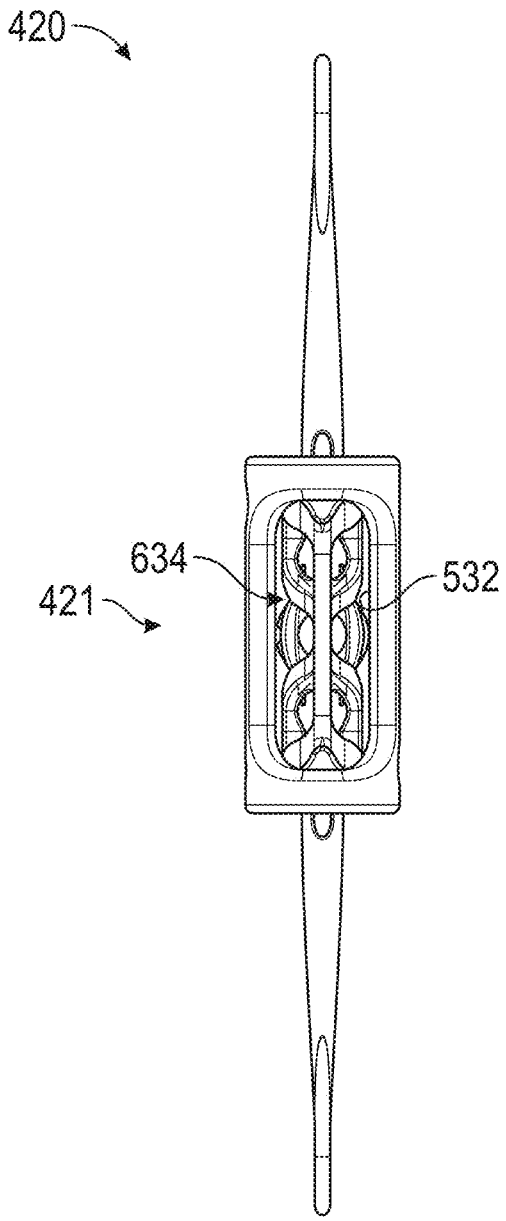
FIG. 6 is an example illustration of a top view of the handle adapter.
Figure 7:
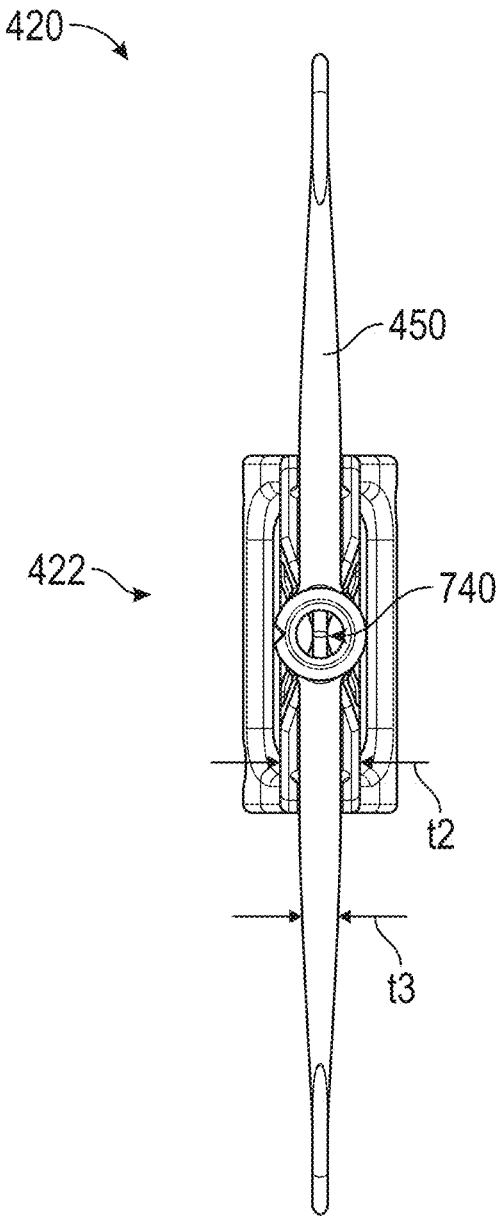
FIG. 7 is an example illustration of a bottom view of the handle adapter.

FIGS. 2-3 are example illustrations of, respectively, a perspective view and a front view of a handle system 200 for towed water sports. The handle system 200 may have many features in common with examples of a handle adapter or handle system shown and described herein, such as the handle system 100 of FIG. 1. The handle system 200 may include a handle adapter 220, a handle 260, and one or more ropes 270 (two ropes are shown in the present example). Features of the handle adapter 220 will be described in more detail, e.g., in discussion of FIGS. 4-11.

The handle 260 may be inserted through a bore (e.g., the bore 524 of FIG. 5) of the handle adapter 220. The handle 260 is shaped and dimensioned for a user to grip the ends thereof. The handle may include grips 262, which may or may not be removable from the handle and/or replaceable thereon. The handle 260 may be bent or may be substantially straight (e.g., a bent or straight rod). The handle 260 may have holes therethrough, such as for attachment of the one or more ropes 270, for receiving a fastener 210, and the like. The handle may be partially, or completely, hollow; e.g., the handle may have the shape of a tube.

The ropes 270 may be passed through channels of the handle adapter (see, e.g., the two channels 426 of FIG. 4 or FIG. 11), and may be structurally configured for connection to a cooperating watercraft. The ropes 270 may be joined together at, or proximate, a distal end 222 of the handle adapter 220 (e.g., by braiding, winding, tying, binding with a strap or similar device, or the like). A grommet 264 may be used to at least partially cover the distal end 222 of the handle adapter 220 such that there is no gap, or a gap of insignificant size, between the rope 270 and the distal end 222 of the handle adapter 220. This feature may further prevent injury to fingers or other body parts that may become caught in such a gap.

Ropes 270 may, for example, extend several feet away from the handle 260 (e.g., ropes may extend by about 5 feet away from the handle 260) and may terminate in a loop 272 which is attachable to a tow rope (not shown) or other connection to a towing watercraft (sec, e.g., watercraft 190 of FIG. 1). In some examples discussed herein, for simplicity, the full length of the ropes 270 may not be shown. However, it will be understood that the ropes 270 in any of the depicted examples may have a general arrangement as shown in FIG. 3, or may be otherwise arranged to achieve an equivalent result.

Figure 8:
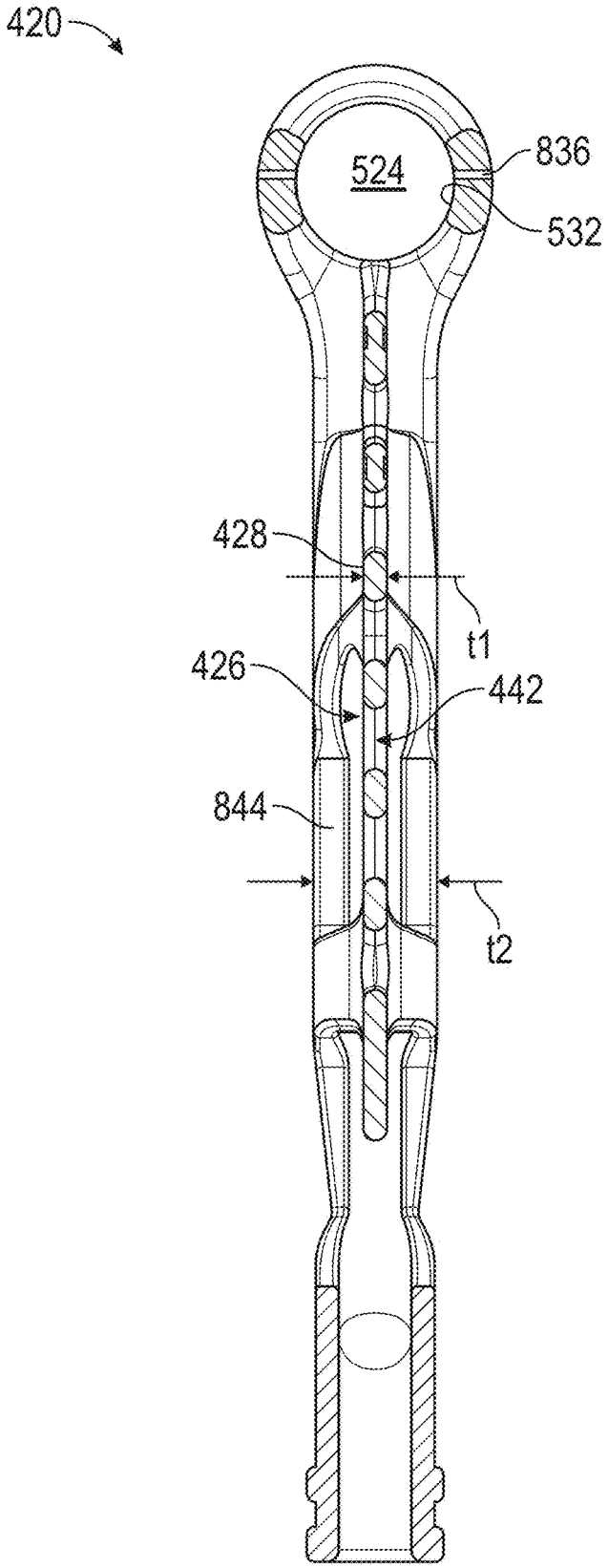
FIG. 8 is an example illustration of an enlarged cross-sectional view taken along the line 8-8 of FIG. 4.
Figure 9:
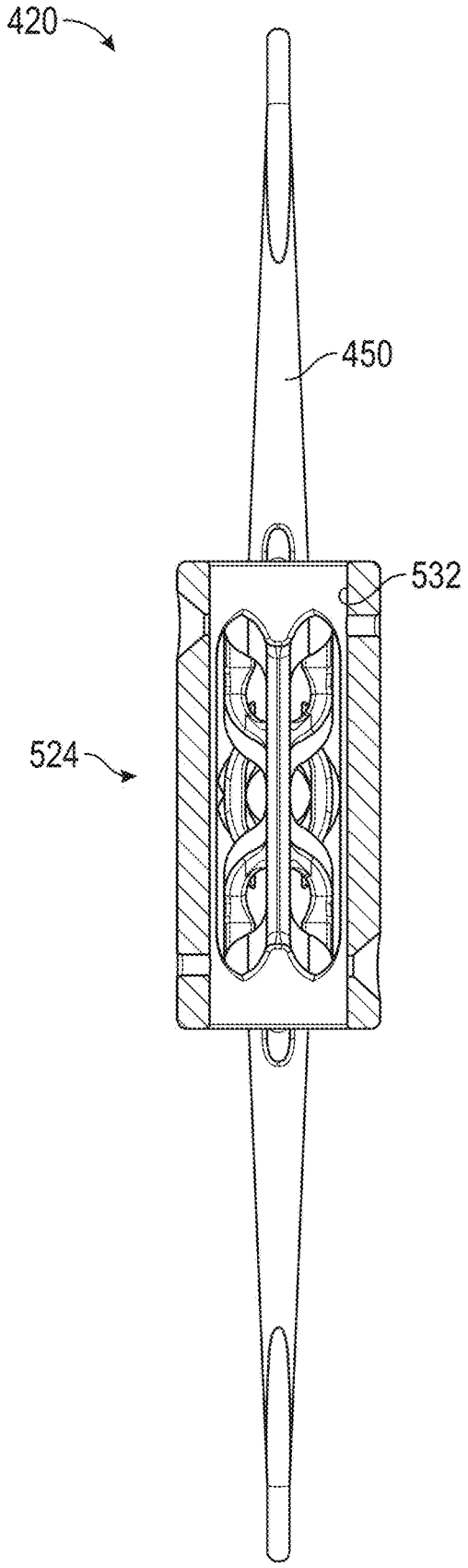
FIG. 9 is an example illustration of an enlarged cross-sectional view taken along the line 9-9 of FIG. 4.
Figure 10:
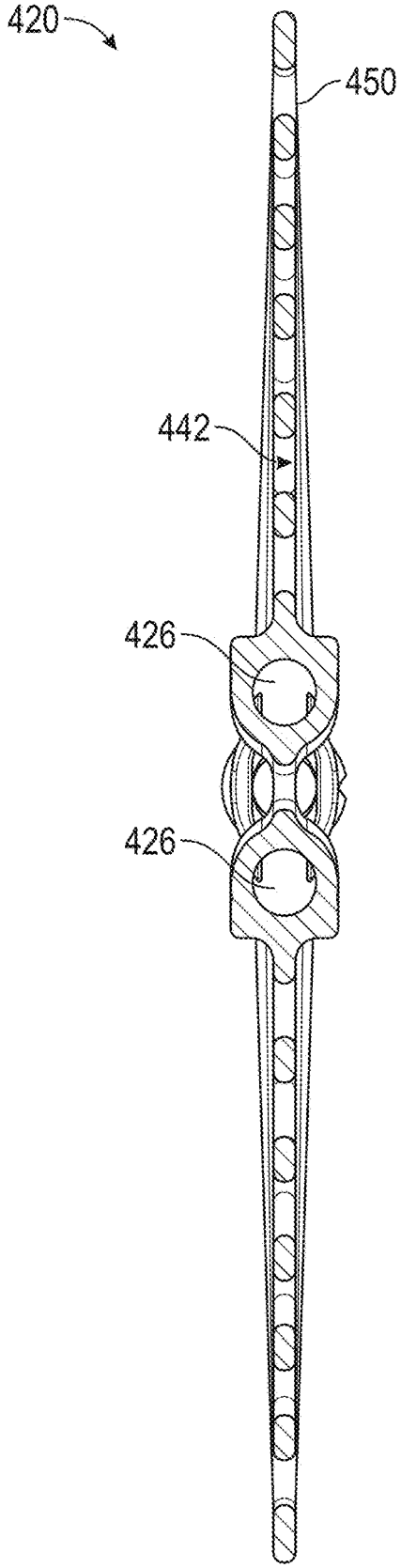
FIG. 10 is an example illustration of an enlarged cross-sectional view taken along the line 10-10 of FIG. 4.
Figure 11:
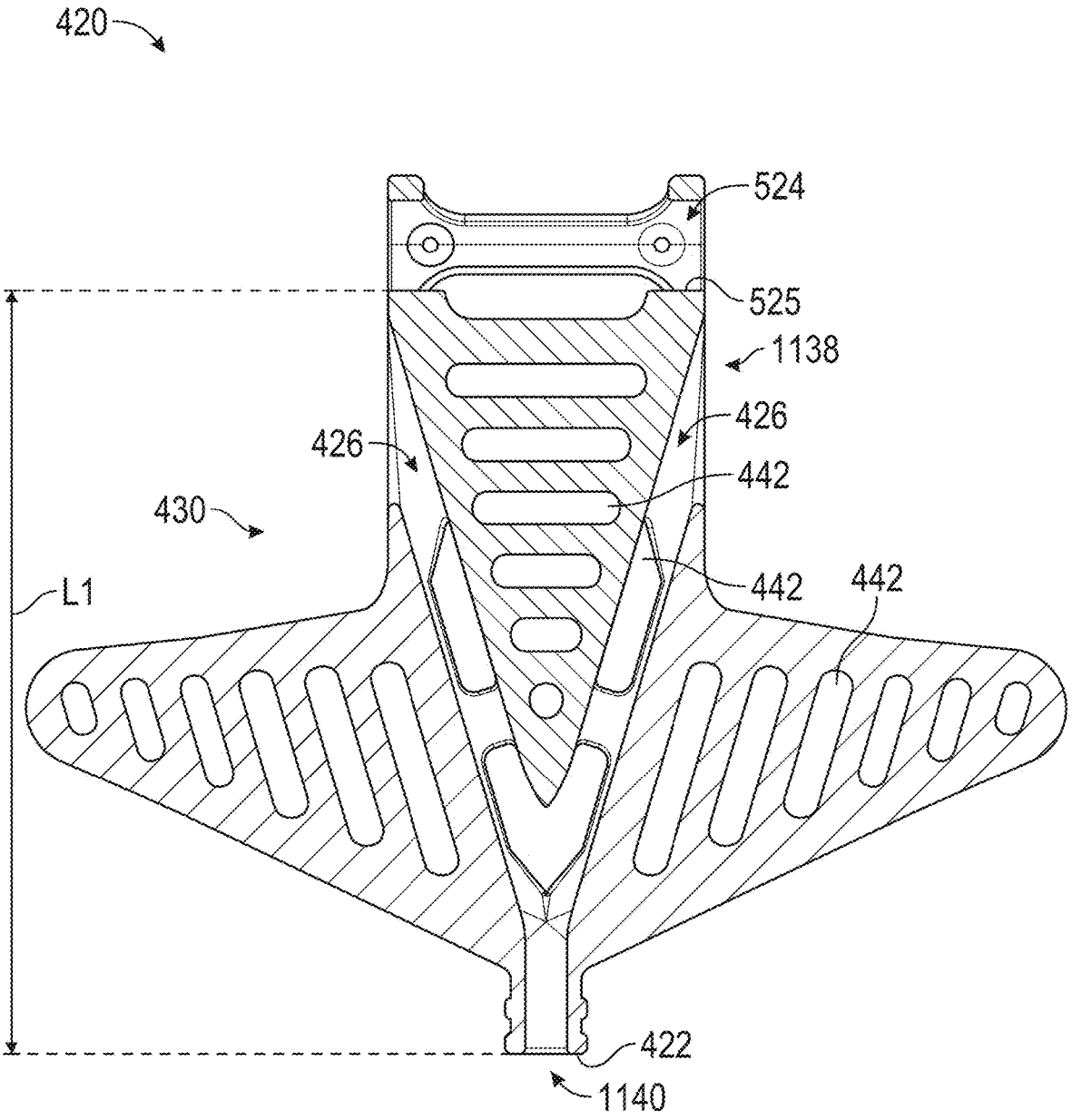
FIG. 11 is an example illustration of a cross-sectional view taken along the line 11-11 of FIG. 5.

FIGS. 4-7 are an example illustrations, respectively, of a front view, a first side view, a top view, and a bottom view of a handle adapter 420. FIGS. 8-10 are example illustrations of enlarged cross-sectional views taken along the correspondingly numbered reference lines of FIG. 4; and FIG. 11 is an example illustration of a cross-sectional view taken along the line 11-11 of FIG. 5. The handle adapter 420 may be configured to cooperate with a rope (e.g., the ropes 270 of FIG. 2) and a handle (e.g., the handle 260 of FIG. 2). The handle adapter 420 may include a bore 524 to receive the handle, two channels 426 to receive the rope, and a central body 428. The handle adapter 420 may have a proximal end 421, a distal end 422, and two outer sides 430.

The bore 524 may be located adjacent the proximal end 421 and may open to both of the two outer sides 430. The bore 524 may be defined by a bore sidewall 532, which may be substantially shaped like a tube, or may have one or more bore apertures 634. The one or more bore apertures 634 may function to reduce weight of the handle adapter 420 or may be provided for aesthetic purposes (e.g., to reveal a portion of the handle). The bore 524 is generally shaped and dimensioned to receive the handle therethrough.

One or more fasteners (see, e.g., fastener 210 of FIG. 3) may be inserted through the bore sidewall 532 (e.g., through a fastener hole 836 in the bore sidewall 532), to connect the handle adapter 420 to the handle. In some cases the fastener may be a screw, and the fastener hole 836 may be threaded to receive the screw. In other cases the fastener hole 836 may not be threaded.

The two channels 426, which may be viewed in cross-section in FIG. 11, are each structurally configured for a section of rope (e.g., ropes 270) to pass therethrough. The two channels 426 may be located adjacent each of the two outer sides 430 of the handle adapter 420 (in other words, one channel 426 may be located adjacent each outer side 430). Each channel 426 may have a proximal channel end 1138 and a distal channel end 1140. Each proximal channel end 1138 is generally configured to receive a rope, or to be accessible for a user to insert a rope therethrough. When the rope is passed through each of the two channels 426 and wrapped around the handle, the two ropes may be held in position on the handle by the handle adapter 420 (see also FIG. 3). In other words, handle adapter 420 prevents the rope from sliding or otherwise shifting from the desired position along the handle. In some cases the ropes may also, or instead, be passed through a hole in the handle. When the handle is received by the bore, the proximal channel ends are located between the two handle ends. This feature allows the ropes to be located between the two handle ends (and therefore between the user's hands when in use).

In some cases, the proximal channel end 1138 may open to an outer side 430, or may open to the proximal end 421. The proximal channel end 1138 may have a tapered opening (e.g., the opening may be angled relative to a primary axis of the channel, as shown in FIG. 11). This configuration may improve case of insertion of the rope, e.g., by providing a relatively large opening relative to the size of a cross-section taken normal to the primary axis of the channel 426. In addition, the cuts in the material may reduce the overall weight of the handle adapter. Similarly, the distal channel end 1140 may open to an outer side 430, or may open to the distal end 422. The distal channel end 1140 may also, or instead, have a tapered opening to case insertion of the rope therethrough. In some cases, such as shown in FIG. 11, the two channels 426 may merge, such that the two ropes may exit the handle adapter 420 via the same opening. Said another way, the distal channel ends 1140 of the two channels 426 may open to a common distal opening (e.g., distal channel end 740 of FIG. 7).

The central body 428 of the handle adapter 420 may be located intermediate the two channels 426 and extend therebetween. In some cases, the central body 428 may extend outwardly beyond the two channels 426 (e.g., in the direction of the two outer sides 430). The central body 428 may extend upwardly to the bore 524 or may extend upwardly at least as far as the proximal channel ends 1138. The central body 428 may extend downwardly to the distal end 422 or may extend downwardly at least as far as the distal channel ends 1140. The central body 428 may function to add stiffness to the handle adapter 420 and prevent the user's body parts from becoming inadvertently caught within the ropes used with the handle adapter (e.g., in the absence of a central body 428, the ropes may be able to move within the handle adapter 420 and may catch the user's body part).

The central body 428 may have a central body thickness (t1, see FIG. 8). Each of the two channels 426 may have a channel sidewall 844 that defines the channel 426. The maximum exterior thickness of the channel sidewall defines a channel thickness (t2, sec FIG. 8). In some aspects, the central body thickness, t1, may be less than the channel thickness, t2. This feature may allow the central body 428 to provide a desirable degree of stiffness or protection while not significantly increasing the overall weight of the handle adapter.

The central body 428 may include a plurality of apertures 442. This feature may be preferred to provide a relatively low weight for the handle adapter 420. The apertures 442 may have any size or shape, and may be placed in any region of handle adapter 420 without being restricted in placement to within the central body (see, e.g., apertures 442 along two channels 426 shown in FIG. 11). In some cases, the central body 428 include an open region (e.g., a large aperture), which may be covered with a mesh or similar material. For example, the central body 428 may include a frame proximate the two channels 426 or the bore 524 while having an open region in the center. In such an example, the handle adapter 420 may include some structural elements (e.g., tubes) in the open region of the central body 428 to provide stiffness. The central body 428 may in some cases be formed of a different material from other portions of the handle adapter 420. Material choices may be made based on preferred weight, stiffness, appearance, and the like. In other cases, the central body 428 may be formed of the same material as other portions of handle adapter 420, or may be unitarily formed with the handle adapter 420.

Referring again to FIGS. 2-3, the handle adapter 220 may include a pair of wings 250. The wings may allow the handle adapter 220 to tip more easily, such as when the user is performing a turn. This feature may improve the safety of the handle adapter 220. One of the wings may extend from the two outer sides of the handle adapter 220 (see also wings 450 extending from the two outer sides 430 in FIG. 4). The wings may have a substantially triangular shape, may be substantially planar, or may have another shape. In an aspect, a majority of each wing may have a thickness (as measured from the side) that is about the same as the central body thickness, t1. In another aspect, a majority of each wing may have a thickness, t3, (see FIG. 7) that is less than the channel thickness, t2. In some cases, the wing may include an upper wing edge 252 and a lower wing edge 254. One or both of the upper wing edge 252 and the lower wing edge 254 may be reinforced; for example, they may have an increased thickness relative to other areas of the wing, they may include different materials, structural elements, or the like.

The size and shape of the wings may be determined based upon desirable size, weight, balance, flexibility, and other features of the handle adapter. In some cases, it may be desirable for the wings 250 to extend outwardly by a distance less than the outward extension of the handle 260. The difference between the wing extension distance and the handle extension distance is shown in FIG. 3 as D1. D1 may be, for example, a distance of between about 1 inch and about 12 inches.

The handle adapter 420 may have a stiffener length, L1, measured from a distal surface 525 of the bore 524 to the distal end 422 of the handle adapter 420 (see L1 of FIG. 11). The stiffener length, L1, determines the pivot point of a handle system including the handle adapter (e.g., the handle system 200), for example, the pivot point when making a turn with one hand on the handle. If L1 is relatively short, the handle may have a tendency to pivot at an extreme angle away from the user and may even slip out of a user's hand. However, it is also desirable to not have L1 be overly long, as this would increase the hazard if a user falls (for example, a relatively large handle system would be more likely to strike an object or the user themselves). There is, therefore, a desirable range of dimensions for stiffener length, L1. For example, the stiffener length L1 may be between about 5 cm and about 50 cm. In some examples, the stiffener length may be between about 5 cm and about 30 cm. In one preferred example, the stiffener length may be between about 10 cm (about 4 inches) and about 24 cm (about 9.5 inches); e.g., the stiffener length may be about 12 cm.

In some cases, the handle adapter of any of the examples discussed herein may be unitarily formed. In other cases, the handle adapter may include multiple pieces that may be interlocked and/or fastened to one another. For example, the handle adapter may be made in two halves, which could be fastened to one another, such as around the handle (effectively clamping on to the handle).

The handle adapter may be formed of materials such as polyamide (e.g., Nylon 11), polycarbonate, high density polyethylene (HDPE), acrylonitrile butadiene styrene (ABS), carbon fiber, and similar lightweight materials. The handle made be formed, for example, of carbon fiber or another strong and lightweight material. The grips may be formed, for example of rubber. The grommet may be formed, for example, of rubber.

In some examples, the handle adapter is shown connected to a cooperating handle or cooperating rope (which may be distributed separately). In other cases, the handle adapter may be packaged with a handle or a rope and used as handle system or handle kit.

Figure 12:
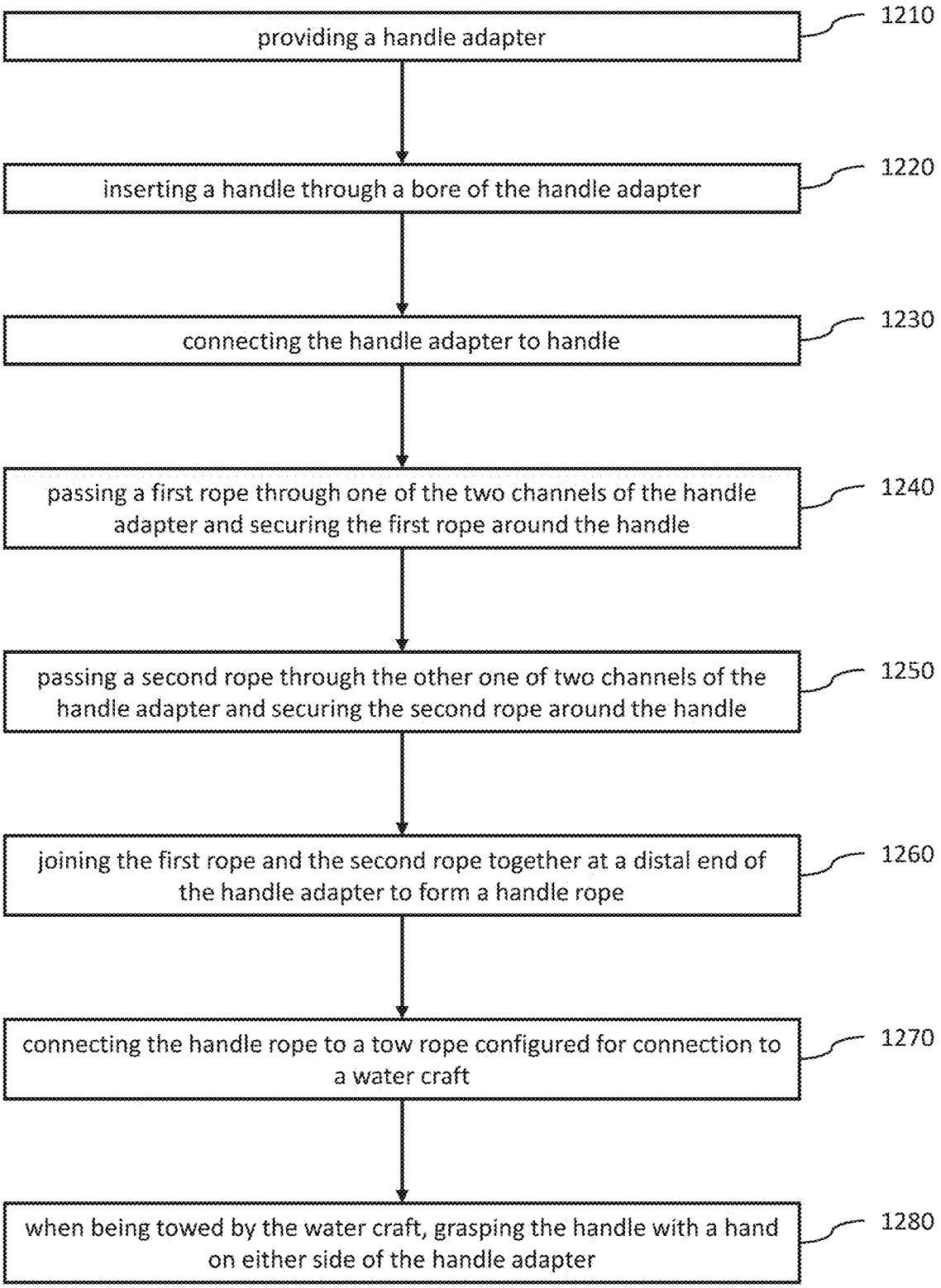
FIG. 12 is an example flow chart illustrating a method of using the handle adapter.
Figure 13:
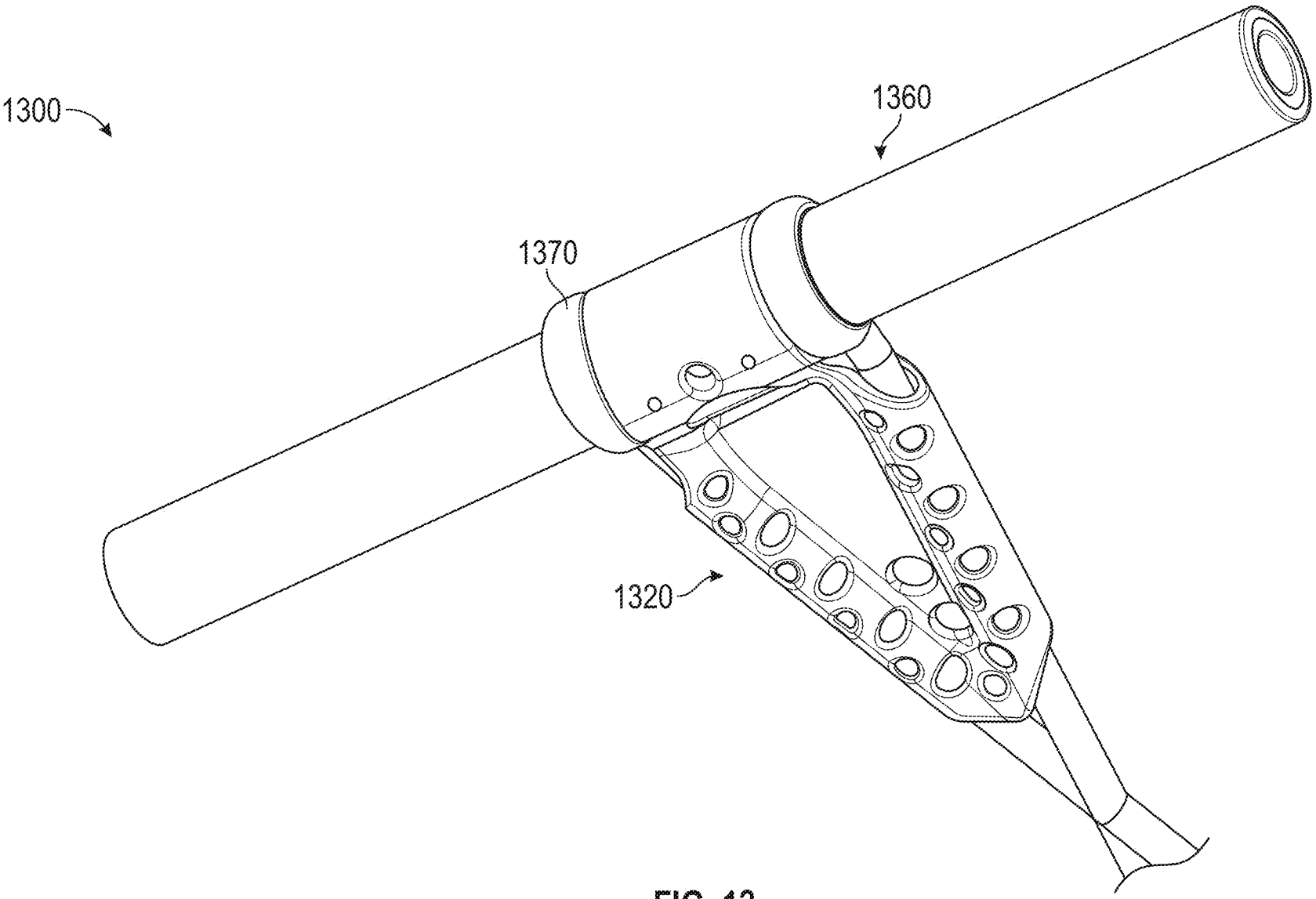
FIG. 13 is an example illustration of a perspective view of the handle adapter, shown in use with a handle.
Figure 14:
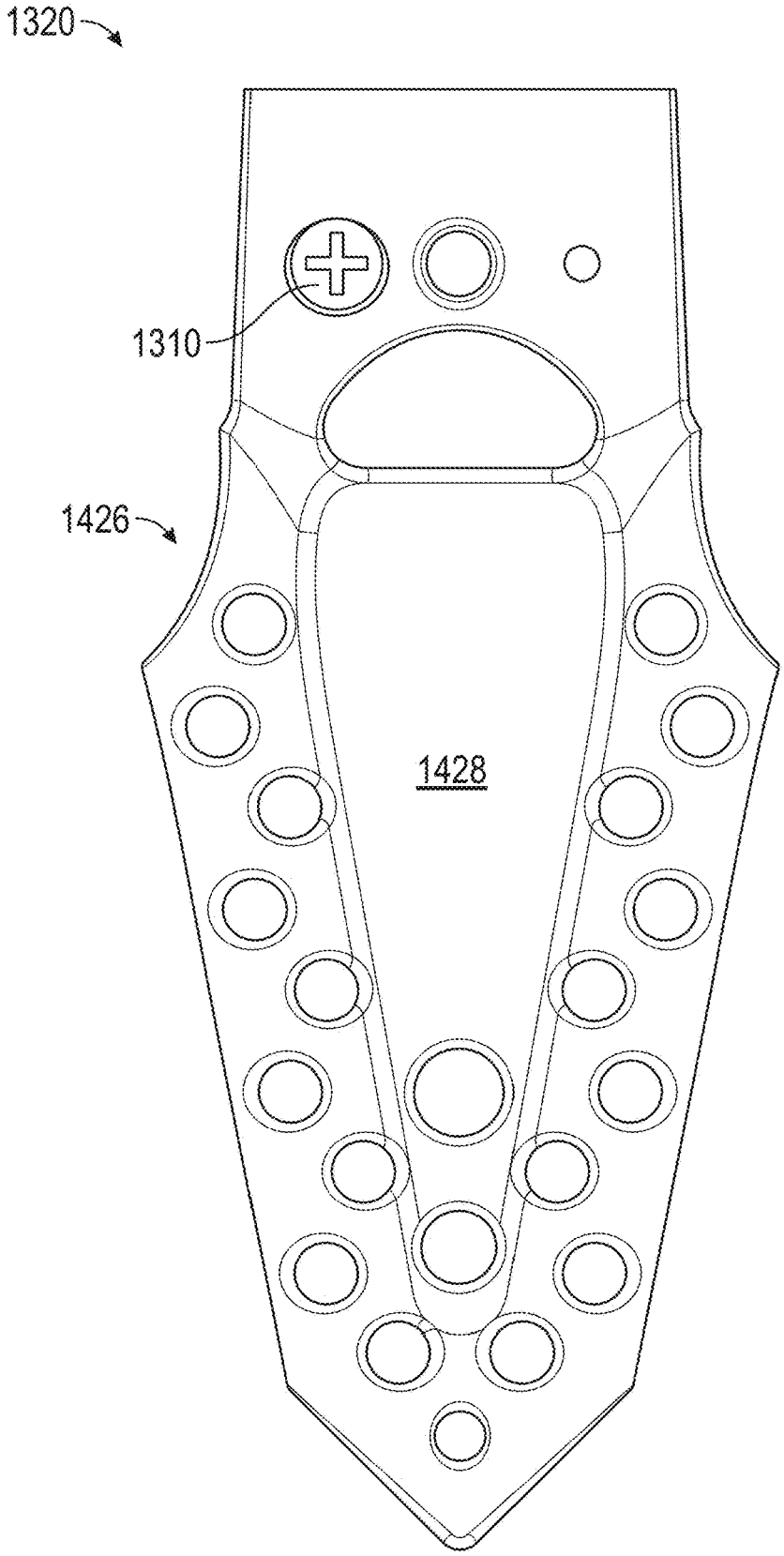
FIG. 14 is an example illustration of a front view of the handle adapter, the rear view being identical, or substantially identical.

In terms of use, a method of using a handle adapter for towed water sports may be performed using any of the example handle adapters or handle systems described herein. The method may include the following steps (refer to FIG. 12):

a) providing, 1210, a handle, a rope, and a handle adapter including:
   - a proximal end, a distal end, and two outer sides;
   - a bore defined by a bore sidewall, the bore located adjacent the proximal end and opening to both of the two outer sides, the bore shaped and dimensioned to receive the handle therethrough;
   - two channels each structurally configured for the rope to pass therethrough, one of the two channels located adjacent each of the two outer sides of the handle adapter, each of the two channels having a channel sidewall, a maximum thickness of the channel sidewall defining a channel thickness;
   - a central body located intermediate the two channels and extending therebetween, the central body having a central body thickness that is less than the channel thickness; and
   - wherein each of the two channels has proximal channel end and a distal channel end, and the proximal channel end opens to one of the two outer sides;

b) inserting, 1220, the handle through the bore of the handle adapter;

c) connecting, 1230, the handle adapter to handle;

d) passing, 1240, a first rope through one of the two channels of the handle adapter and securing the first rope around the handle;

e) passing, 1250, a second rope through the other one of two channels of the handle adapter and securing the second rope around the handle;

f) joining, 1260, the first rope and the second rope together at a distal end of the handle adapter to form a handle rope (which, in some cases, may occur before steps (d) or (e), e.g., the two ropes may be joined together first and then passed through the two channels);

g) connecting, 1270, the handle rope to a tow rope configured for connection to a watercraft; and h) when being towed by the watercraft, grasping, 1280, the handle with a hand on either side of the handle adapter.

FIGS. 13-17 are example illustrations, respectively, of a perspective view, a front view, a first side view, a top view, and a bottom view of a handle adapter 1320. The handle adapter 1320 may cooperate with a handle 1360 and one or more ropes 1370 to form a handle system 1300, which may have many features in common with other handle systems described herein. The handle adapter 1320 includes two channels 1426, a central body 1428, and a bore 1524.

Figure 15:
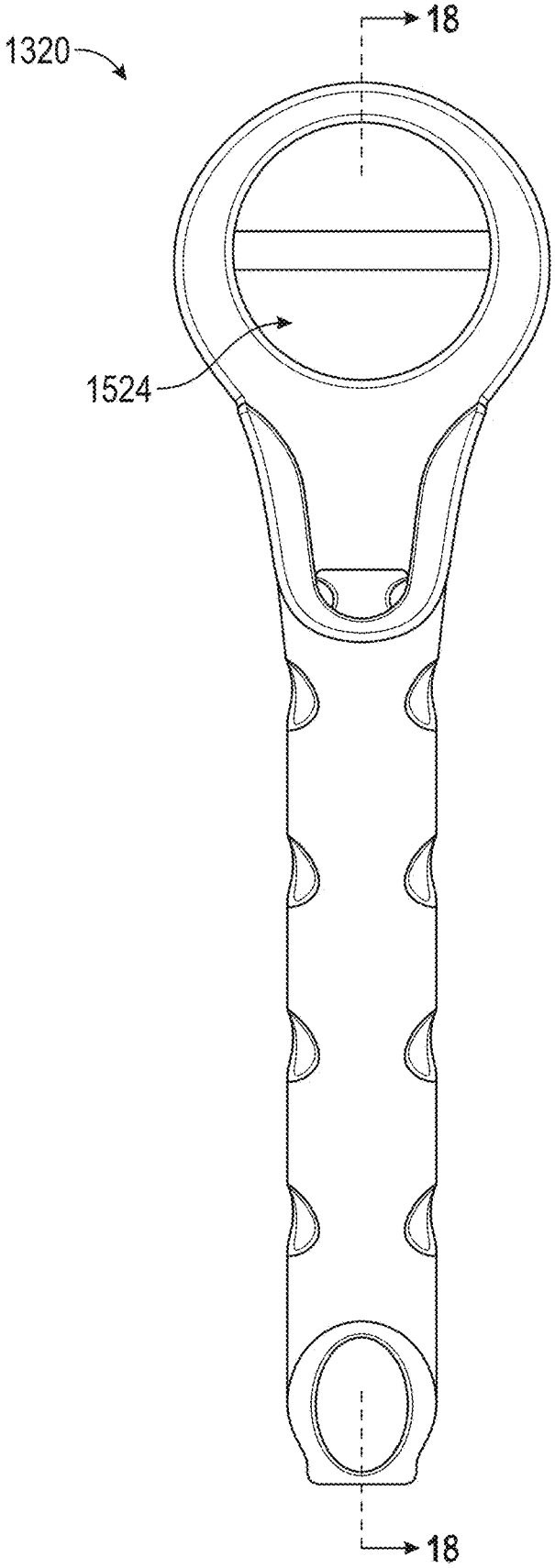
FIG. 15 is an example illustration of a first side view of the handle adapter, the opposing second side view being, or substantially being, a mirror image.
Figure 16:
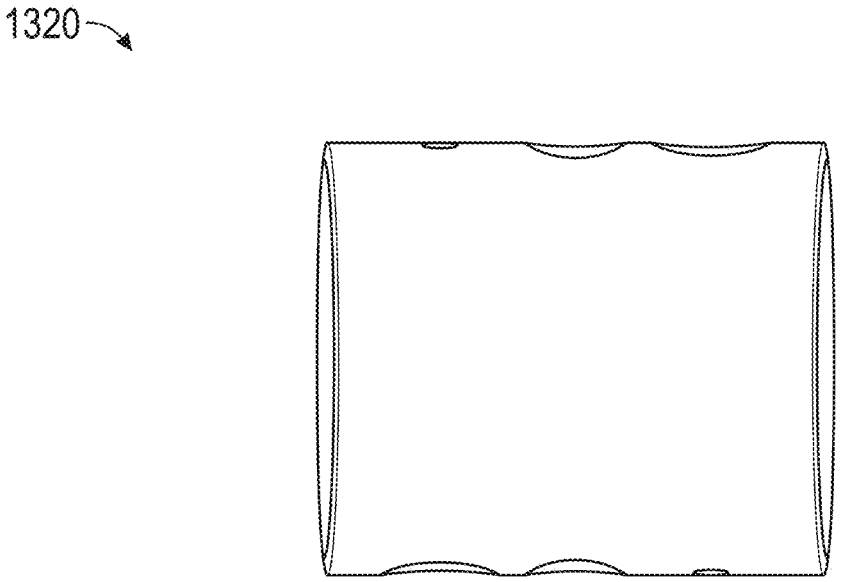
FIG. 16 is an example illustration of a top view of the handle adapter.
Figure 17:
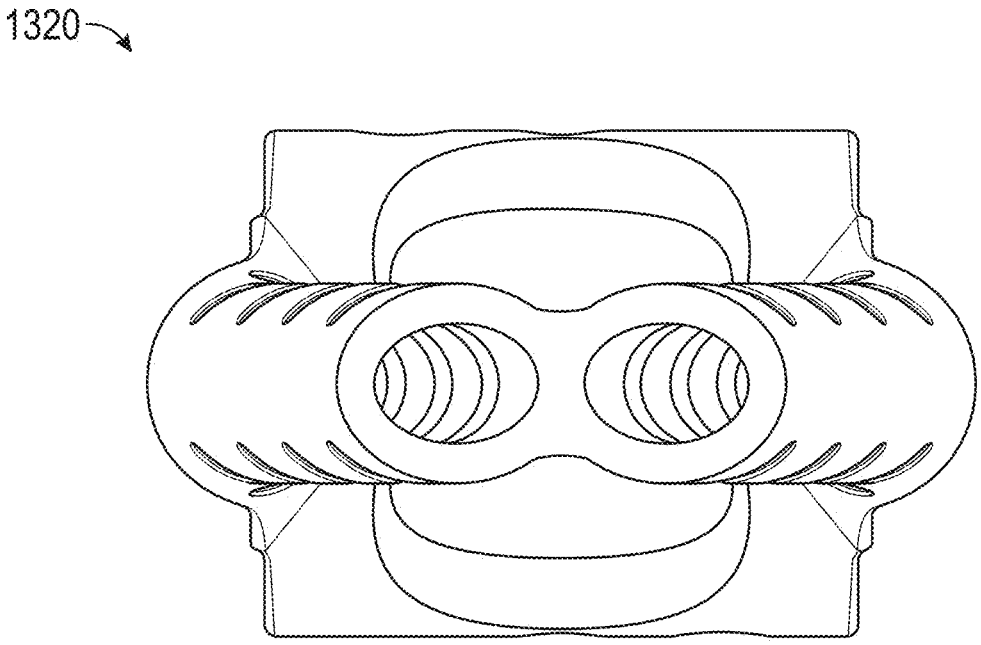
FIG. 17 is an example illustration of a bottom view of the handle adapter.
Figure 18:
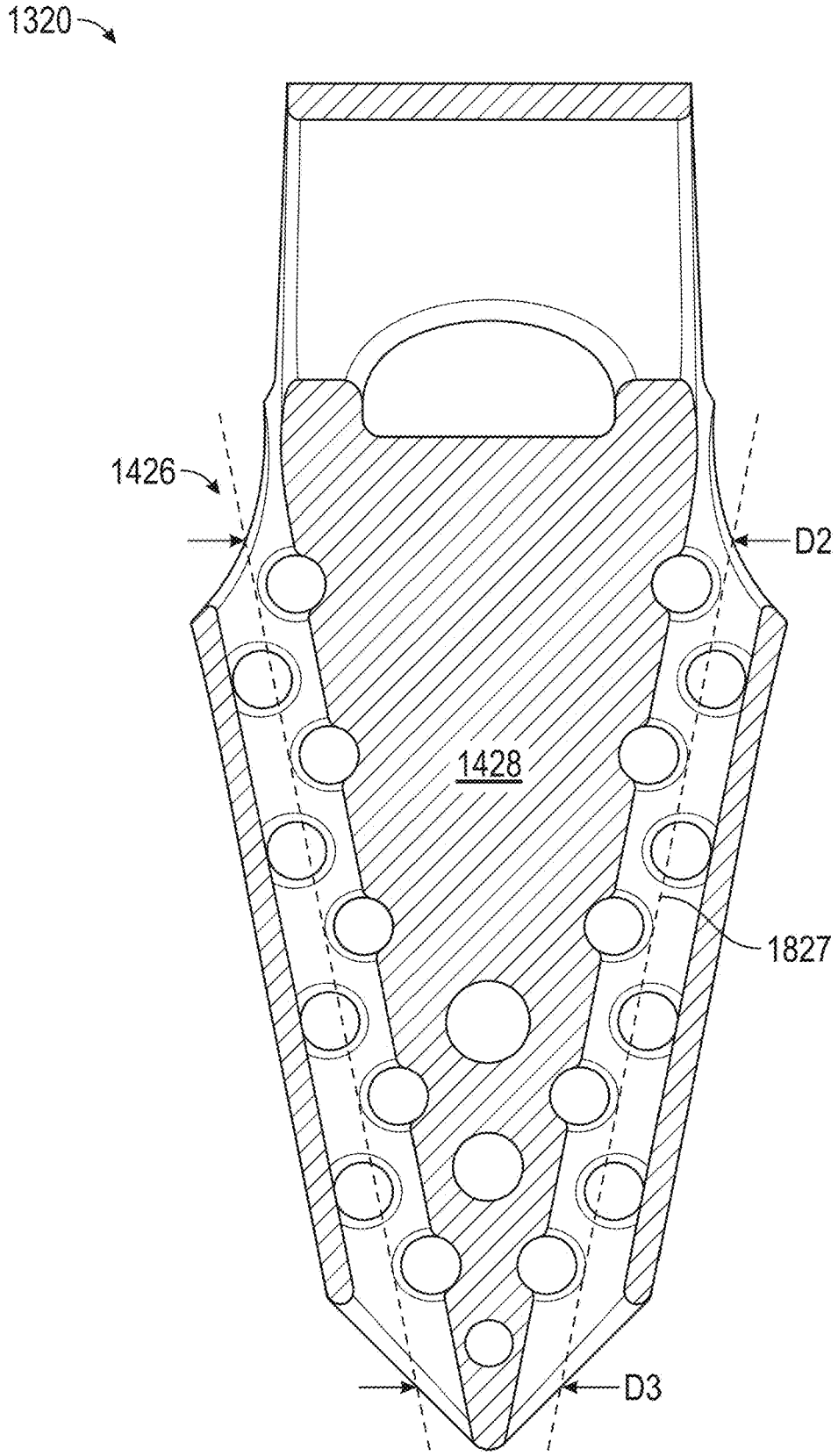
FIG. 18 is an example illustration of a cross-sectional view taken along the line 18-18 of FIG. 15.

FIG. 18 an example illustration of a cross-sectional view taken along the line 18-18 of FIG. 15. The two channels 1426 may be angled such that a first distance, D2, measured between the proximal ends of the two channels is larger than a second distance, D3, measured between the distal ends of the two channels. The measurements D2 and D3 may be taken from a central channel axis 1827 of each of the two channels 1426. Said another way, the two channels 1426 may be angled inwardly from the proximal end of the handle adapter 1320 to the distal end. This feature allows ropes to be wound, tied, or bound together without leaving a significantly sized gap between either rope and handle adapter. This is desirable because any gap between a rope and the handle adapter may present a safety hazard (for example, a finger may be caught in the rope).

The examples of the handle adapter and systems and methods of use described herein are exemplary and numerous modifications, combinations, variations, and rearrangements can be readily envisioned to achieve an equivalent result, all of which are intended to be embraced within the scope of the appended claims. Further, nothing in the above-provided discussions of the handle adapter, systems, and methods should be construed as limiting the invention to a particular example or combination of examples. The scope of the invention is defined by the appended claims.

I claim:

1. A handle adapter for towed water sports, the handle adapter configured to cooperate with a rope and a handle having two handle ends, the handle adapter comprising:

a proximal end, a distal end, and two outer sides;

a substantially planar wing extending from each of the two outer sides;

a bore defined by a bore sidewall, the bore located adjacent the proximal end and opening to both of the two outer sides, the bore shaped and dimensioned to receive the handle therethrough;

two channels each structurally configured for the rope to pass therethrough, one of the two channels located adjacent each of the two outer sides, each of the two channels having a channel sidewall, a maximum thickness of the channel sidewall defining a channel thickness;

a central body located intermediate the two channels and extending therebetween, the central body having a central body thickness that is less than the channel thickness;

wherein each of the two channels has a proximal channel end and a distal channel end, and the proximal channel end opens to one of the two outer sides; and wherein, when the handle is received by the bore, the proximal channel ends are located between the two handle ends.

2. The handle adapter of claim 1, wherein at least one of the proximal channel end and the distal channel end is tapered.

3. The handle adapter of claim 1, wherein the handle adapter has a stiffener length measured from the distal end to a distal surface of the bore, the stiffener length being between about 10 cm and about 24 cm.

4. The handle adapter of claim 1, wherein the central body includes a plurality of apertures.

5. The handle adapter of claim 1, wherein the handle adapter is unitarily formed.

6. The handle adapter of claim 1, further configured to cooperate with a fastener, wherein the bore sidewall includes a fastener hole structurally configured to receive the fastener.

7. The handle adapter of claim 1, wherein the two channels are angled such that a first distance measured between the proximal channel ends of the two channels is larger than a second distance measured between the distal channel ends of the two channels.

8. The handle adapter of claim 7, wherein the distal channel ends of the two channels open to a common distal opening.

9. A handle system for towed water sports, the handle system configured to cooperate with a rope, the handle system comprising:

a handle adapter including:

a proximal end, a distal end, and two outer sides;

a substantially planar wing extending from each of the two outer sides;

a bore defined by a bore sidewall, the bore located adjacent the proximal end and opening to both of the two outer sides;

two channels each structurally configured for the rope to pass therethrough, one of the two channels located adjacent each of the two outer sides of the handle adapter, each of the two channels having a channel sidewall, a maximum thickness of the channel sidewall defining a channel thickness;

a central body located intermediate the two channels and extending therebetween, the central body having a central body thickness that is less than the channel thickness;

wherein each of the two channels has proximal channel end and a distal channel end, and the proximal channel end opens to one of the two outer sides; and a handle inserted through the bore of the handle adapter and structurally configured for a user to grip two handle ends thereof, each of the two handle ends located on opposing sides of the bore and the proximal channel ends located between the two handle ends.

10. The handle of claim 9, further including a rope passed through the two channels of the handle adapter, the rope structurally configured for connection to a cooperating watercraft.

11. A method of towing a user by a watercraft, the method including:

a) providing a handle adapter including:

a proximal end, a distal end, and two outer sides;

a substantially planar wing extending from each of the two outer sides;

a bore defined by a bore sidewall, the bore located adjacent the proximal end and opening to both of the two outer sides;

two channels, one of the two channels located adjacent each of the two outer sides of the handle adapter, each of the two channels having a channel sidewall, a maximum thickness of the channel sidewall defining a channel thickness;

a central body located intermediate the two channels and extending therebetween, the central body having a central body thickness that is less than the channel thickness; and wherein each of the two channels has proximal channel end and a distal channel end, and the proximal channel end opens to one of the two outer sides;

b) inserting a handle through the bore of the handle adapter, the handle having two handle ends configured for gripping by a hand of the user;

c) connecting the handle adapter to the handle;

d) passing a first rope through one of the two channels of the handle adapter and securing the first rope around the handle between the two handle ends;

e) passing a second rope through the other of the two channels of the handle adapter and securing the second rope around the handle between the two handle ends;

f) joining the first rope and the second rope together at the distal end of the handle adapter to form a handle rope;

g) connecting the handle rope to a tow rope configured for connection to the watercraft; and h) when being towed by the watercraft, the user grasping the handle with a hand on each of the two handle ends.

* * * * *